US008578603B2

(12) United States Patent
Kato et al.

(10) Patent No.: US 8,578,603 B2
(45) Date of Patent: Nov. 12, 2013

(54) COMPRESSOR AND MANUFACTURING METHOD THEREOF

(75) Inventors: Hiroyasu Kato, Kariya (JP); Masaaki Okuda, Gamagori (JP)

(73) Assignee: Denso Corporation, Kariya (JP)

( * ) Notice: Subject to any disclaimer, the term of this patent is extended or adjusted under 35 U.S.C. 154(b) by 458 days.

(21) Appl. No.: 12/932,116

(22) Filed: Feb. 17, 2011

(65) Prior Publication Data

US 2011/0200471 A1 Aug. 18, 2011

(30) Foreign Application Priority Data

Feb. 18, 2010 (JP) ..... 2010-033619

(51) Int. Cl.
*B23P 15/00* (2006.01)
*F04B 17/00* (2006.01)
*F04B 35/04* (2006.01)

(52) U.S. Cl.
USPC ..... 29/888.022; 29/888.02; 417/53; 417/410.5; 417/902

(58) Field of Classification Search
USPC ..... 417/53, 313, 410.5, 902; 29/888.02, 29/888.022, 888.023
See application file for complete search history.

(56) References Cited

U.S. PATENT DOCUMENTS

| | | | | |
|---|---|---|---|---|
| 3,021,995 | A * | 2/1962 | Neubauer | 417/419 |
| 6,603,096 | B2 * | 8/2003 | Lee et al. | 219/124.34 |
| 6,872,057 | B2 * | 3/2005 | Kim | 417/312 |
| 7,179,061 | B2 * | 2/2007 | Horton et al. | 417/220 |

FOREIGN PATENT DOCUMENTS

| | | |
|---|---|---|
| JP | U-S60-045890 | 3/1985 |
| JP | A-S63-097376 | 4/1988 |
| JP | 2008-215284 | 9/2008 |
| JP | 2011-127462 | 6/2011 |
| JP | 2011-157895 | 8/2011 |

OTHER PUBLICATIONS

Office action dated Jul. 2, 2013 in corresponding Japanese Application No. 2010-033619.

* cited by examiner

*Primary Examiner* — Peter J Bertheaud
(74) *Attorney, Agent, or Firm* — Harness, Dickey & Pierce, PLC

(57) ABSTRACT

A compressing device, a drive shaft and a bearing device are assembled into a tubular member. All-around welding of a cover member to the tubular member is performed to form a casing in such a manner that welding is overlapped over a welding start point, at which the all-around welding is started, to form an overlapped portion in a welding bead generated by the all-around welding. In the all-around welding, heat input is externally applied to a diametrically opposite portion of the casing, which is diametrically opposite to the overlapped portion, so that the diametrically opposite portion is deformed symmetrically with respect to a welding distortion at the overlapped portion.

7 Claims, 5 Drawing Sheets

COMPRESSOR AND MANUFACTURING METHOD THEREOF

CROSS REFERENCE TO RELATED APPLICATION

This application is based on and incorporates herein by reference Japanese Patent Application No. 2010-33619 filed on Feb. 18, 2010.

BACKGROUND OF THE INVENTION

1. Field of the Invention

The present invention relates to a compressor and a manufacturing method thereof.

2. Description of Related Art

For instance, Japanese Unexamined Patent Publication No. 2008-215284A teaches a compressor, which includes a compressing device and an electric motor device received in a casing. The compressing device is configured to compress refrigerant, and the electric motor device is configured to drive the compressing device. The compressing device and the electric motor device are coupled with each other through a drive shaft. A bearing device, which rotatably supports the drive shaft, is fixed in the casing.

The casing includes a cylindrical tubular body portion and upper and lower cover portions. The upper and lower cover portions are fixed to upper and lower end parts, respectively, of the cylindrical tubular body portion by welding.

The compressor of Japanese Unexamined Patent. Publication. No. 2008-215284A is assembled through the following assembling procedure. That is, the compressing device, the electric motor device, the drive shaft and the bearing device are assembled into the cylindrical tubular body portion of the casing. Thereafter, the upper and lower cover portions are fixed to the upper and lower end parts, respectively, of the cylindrical tubular body portion by welding.

The inventors of the present invention have proposed to provide a required sealing performance of the casing by executing all-around welding (360 degree welding) to weld between the cylindrical tubular body portion and each of the upper and lower cover portions along the entire circumference of the cylindrical tubular portion. Furthermore, in order to limit a seal failure at a welding start point where the weld penetration is unstable, the inventors of the present invention have also proposed to execute the welding through an angular range of 360 degrees+$\alpha$. Here, "$\alpha$" denotes an additional angle. In this way, a welding end point is located beyond the welding start point, so that a welding bead at the welding start point and a welding bead at the welding end point are overlapped with each other.

However, when the welding beads are overlapped with each other to form an overlapped portion, the amount of heat input at the overlapped portion becomes large, and thereby a welding distortion becomes large at the overlapped portion. Therefore, the inner diameter of the casing at the overlapped portion becomes smaller than the inner diameter of the casing at the other circumferential portion (see FIG. 5A described below).

Therefore, the location of the bearing device, which is assembled into the casing, may be deviated from its appropriate location (designated location), and thereby the location of the drive shaft may be also deviated from its appropriate location (designated location). Therefore, an operational reliability of the compressor is disadvantageously deteriorated.

SUMMARY OF THE INVENTION

The present invention is made in view of the above disadvantages to address at least one of the above disadvantages.

According to the present invention, there is provided a compressor that includes a compressing device, a casing, a drive shaft and a bearing device. The compressing device is configured to compress fluid. The casing receives the compressing device. The drive shaft drives the compressing device. The bearing device rotatably supports the drive shaft relative to the casing. The casing includes a tubular member, which extends coaxially with respect to the drive shaft, and a cover member, which covers an end opening of the tubular member. The cover member is fixed to the tubular member by all-around welding. A welding bead is formed by the all-around welding in an outer peripheral surface of the casing along an entire circumference of the casing. The welding bead includes an overlapped portion, which is formed by overlapping of welding over a welding start point, at which the all-around welding is started. A thermally deformed portion, which is deformed by externally applied heat input, is formed in a diametrically opposite portion of the casing, which is diametrically opposite to the overlapped portion. The thermally deformed portion is deformed symmetrically with respect to a welding distortion at the overlapped portion.

According to the present invention, there is also provided a compressor that includes a compressing device, a casing, a drive shaft and a bearing device. The compressing device is configured to compress fluid. The casing receives the compressing device. The drive shaft drives the compressing device. The bearing device rotatably supports the drive shaft relative to the casing. The casing includes a tubular member, which extends coaxially with respect to the drive shaft, and a cover member, which covers an end opening of the tubular member. The cover member is fixed to the tubular member by all-around welding. A welding bead is formed by the all-around welding in an outer peripheral surface of the casing along an entire circumference of the casing. The welding bead includes an overlapped portion, which is formed by overlapping of welding over a welding start point, at which the all-around welding is started. An additional bead is formed in a diametrically opposite portion of the casing, which is diametrically opposite to the overlapped portion, by additional welding that is executed in addition to the all-around welding.

According to the present invention, there is also provided a manufacturing method of a compressor that includes a compressing device, which is configured to compress fluid, a casing, which receives the compressing device, a drive shaft, which drives the compressing device, and a bearing device, which rotatably supports the drive shaft relative to the casing. The casing includes a tubular member, which extends coaxially with respect to the drive shaft, and a cover member, which covers an end opening of the tubular member. In the manufacturing method, the compressing device, the drive shaft and the bearing device are assembled into the tubular member. Then, there is performed all-around welding of the cover member to the tubular member, into which the compressing device, the drive shaft and the bearing device are assembled, to form the casing in such a manner that welding is overlapped over a welding start point, at which the all-around welding is started, to form an overlapped portion in a welding bead generated by the all-around welding. The performing of the all-around welding includes externally applying heat input to a diametrically opposite portion of the casing, which is diametrically opposite to the overlapped portion, so that the diametrically opposite portion is deformed symmetrically with respect to a welding distortion at the overlapped portion.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Now, a first embodiment of the present invention will be described with reference to the accompanying drawings. In the present embodiment, a compressor of the present invention is applied to a heat pump cycle (not shown) of a hot-water supply apparatus.

The heat pump cycle is a vapor compression refrigeration cycle, in which a compressor, a water-refrigerant heat exchanger, a decompression device, an evaporator and a gas-liquid separator are connected one after another through a conduit. The water-refrigerant heat exchanger exchanges the heat between the refrigerant, which is discharged from a refrigerant discharge outlet of the compressor, and water to heat the water. The decompression device-decompresses the refrigerant, which is outputted from the water-refrigerant heat exchanger. The evaporator absorbs heat from the outside air to evaporate the decompressed refrigerant, which is decompressed in the decompression device. The gas-liquid separator separates the refrigerant outputted from the evaporator into liquid-phase refrigerant and gas-phase refrigerant. The gas-liquid separator stores excess refrigerant as the liquid-phase refrigerant and supplies the gas-phase refrigerant to the refrigerant suction inlet of the compressor. Here, it should be noted that the gas-liquid separator is not absolutely necessary and may be eliminated depending on a need.

The heat pump cycle of the present embodiment constitutes a supercritical refrigeration cycle. Specifically, carbon dioxide is used as the refrigerant of the heat pump cycle, and the pressure of the high pressure refrigerant discharged from the compressor is made equal to or higher than the critical pressure of the refrigerant.

Figure 1:
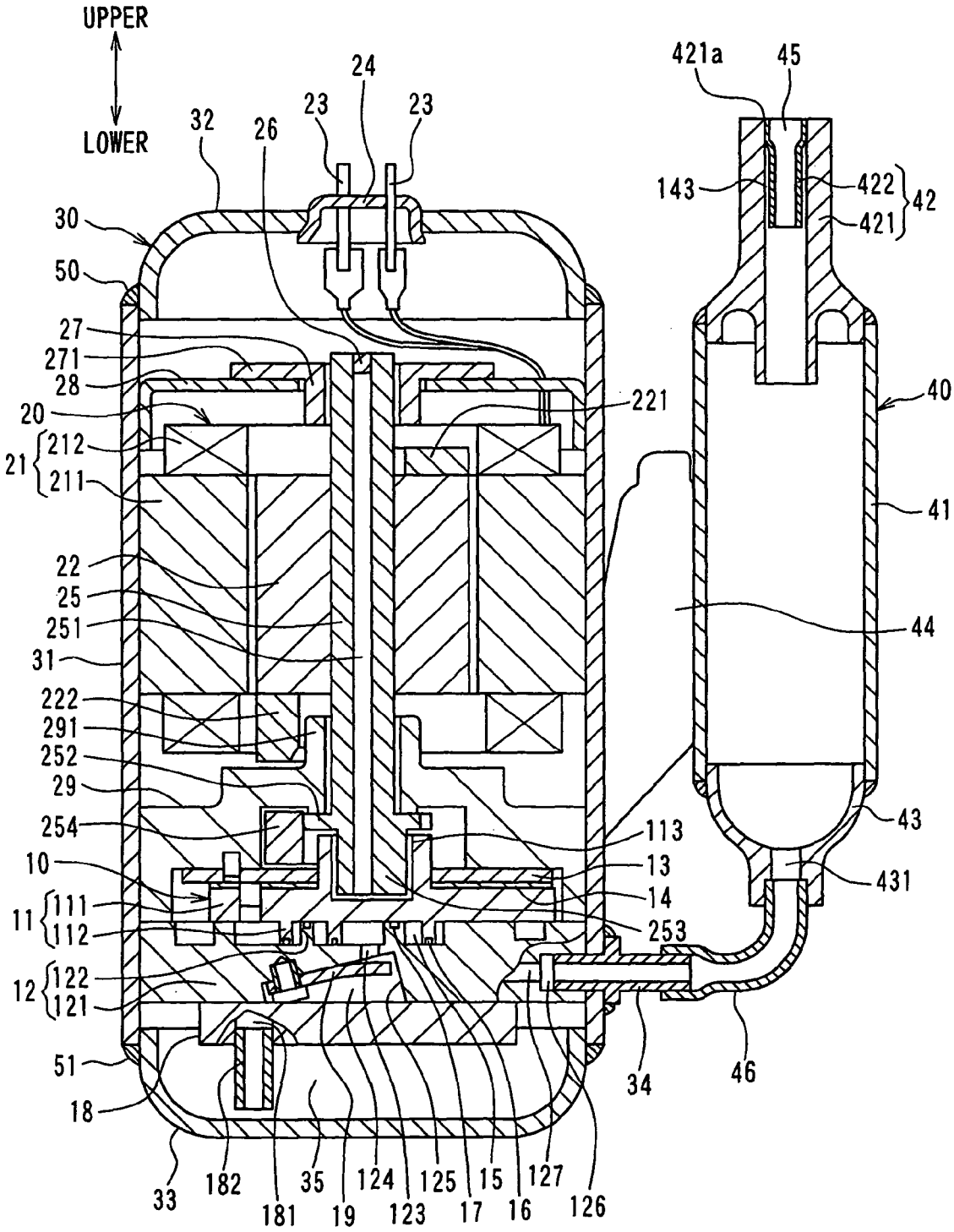
FIG. 1 is a schematic cross-sectional view showing a compressor according to a first embodiment of the present invention.

FIG. 1 is a schematic cross-sectional view of the compressor. In FIG. 1, a double sided arrow with indications of "upper" and "lower" indicates a top-to-bottom direction in an installed state of the compressor.

The compressor is an electric scroll compressor and includes a compressing device 10 and an electric motor device 20. The compressing device 10 is configured to compress refrigerant, and the electric motor device 20 is configured to drive the compressing device 10. The compressing device 10 and the electric motor device 20 are arranged one after another in the top-to-bottom direction (vertical direction), so that the compressor of the present embodiment is formed as an upright compressor (upright type compressor). Specifically, the compressing device 10 is placed on a lower side (bottom side) of the electric motor device 20.

The compressing device 10 and the electric motor device 20 are received in a casing (housing) 30. An oil separator 40 is placed at an outside of the casing 30 to separate lubricating oil from the refrigerant, which is compressed at the compressing device 10. Each of the casing 30 and the oil separator 40 is configured into an elongated body, which is elongated in the top-to-bottom direction. The oil separator 40 is placed on a lateral side (radially outer side) of the casing 30.

The casing 30 includes a tubular member 31, an upper cover member 32 and a lower cover member 33 and forms a closed vessel. The tubular member 31 is elongated in, i.e., extends in the top-to-bottom direction. The upper cover member 32 closes an upper end opening of the tubular member 31, and the lower cover member 33 closes a lower end opening of the tubular member 31.

Specifically, the tubular member 31 is configured into a cylindrical tubular form and is made of iron metal. Each of the upper and lower cover members 32, 33 is configured into a bowl form and is made of iron metal. A wall thickness of each of the tubular member 31, the upper cover member 32 and the lower cover member 33 is, for instance about 4 to 5 mm. The upper and lower cover members 32, 33 are press-fitted into the tubular member 31 and are fluid-tightly joined to the tubular member 31 by welding.

Figure 2:
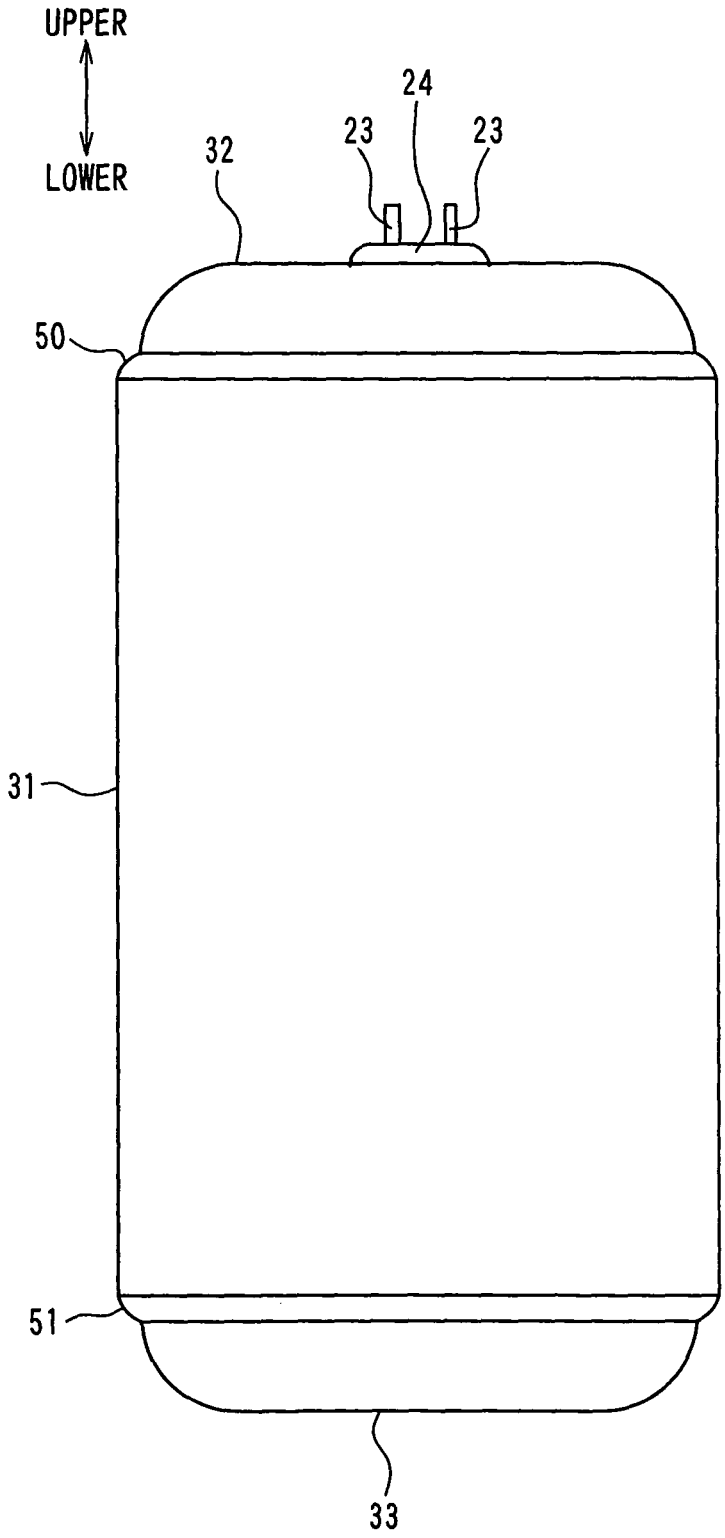
FIG. 2 is a schematic side view indicating the compressor of FIG. 1.
Figure 3:
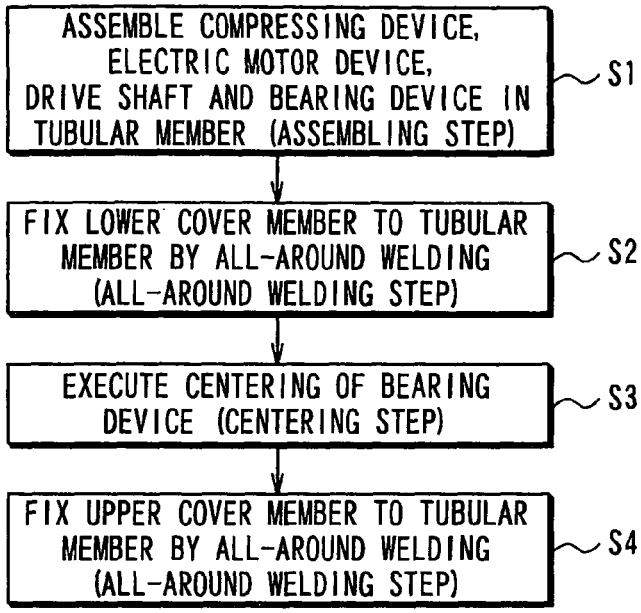
FIG. 3 is a flowchart showing a manufacturing method of the compressor shown in FIG. 1.

FIG. 2 is a schematic side view showing the casing 30 of the compressor shown in FIG. 1. The upper cover member 32 is welded to the tubular member 31 along the entire circumference (i.e., throughout an angular range of 360 degrees) of the tubular member 31 by, for example, metal active gas welding. Therefore, a welding bead 50 is formed upon the welding of the upper cover member 32 and the tubular member 31 to extend along the entire circumference of the casing 30.

Similarly, the lower cover member 33 is welded to the tubular member 31 along the entire circumference of the lower cover member 33. A welding bead 51 is formed upon the welding of the lower cover member 33 and the tubular member 31 to extend along the entire circumference of the casing 30. Through the formation of the welding beads 50, 51, the fluid-tightness (sealing) of the casing 30 is implemented.

As shown in FIG. 1, the electric motor device 20 includes a stator 21 and a rotor 22. The stator 21 is configured into a cylindrical tubular form, which is elongated, i.e., extends in the top-to-bottom direction. The stator 21 is fixed to the tubular member 31 of the casing 30. Specifically, the stator 21 includes a stator core 211 and stator coils 212. The stator coils 212 are wound around the stator core 211.

An electric power is supplied to the stator coils 212 through power supply terminals 23. The power supply terminals 23 are placed at the upper end part of the casing 30. Specifically, the power supply terminals 23 extend through a power supply terminal fixing plate 24, and the power supply terminal fixing plate 24 is fixed to the upper cover member 32 of the casing 30 such that the power supply terminal fixing plate 24 closes a through hole, which is formed in a center part of the upper cover member 32.

The rotor 22 includes permanent magnets and is placed radially inward of the stator 21. The rotor 22 is configured into a cylindrical tubular body, which is elongated in, i.e., extends in the top-to-bottom direction. A drive shaft 25, which extends in the top-to-bottom direction, is fixed to a center hole of the rotor 22 by press-fitting such that the drive shaft 25 is coaxial with the tubular member 31. When the electric power is supplied to the stator coils 212, a rotating magnetic field is applied to the rotor 22 to generate a rotational force at the rotor 22, and thereby the rotor 22 is rotated together with the drive shaft 25.

The drive shaft 25 is configured into a cylindrical tubular body, and an oil supply passage 251 is formed in an interior space of the drive shaft 25 to supply the lubricating oil to slidable parts of the drive shaft 25. A lower end part of the oil supply passage 251 opens in a lower end surface of the drive shaft 25, and an upper end part of the oil supply passage 251 is closed by a closing member 26 at an upper end surface of the drive shaft 25.

The lower end portion of the drive shaft 25 (i.e., the end portion of the drive shaft 25 located on the compressing device 10 side of the rotor 22) projects from the rotor 22 toward the lower side on the lower side of the rotor 22. A flange 252 is formed in a portion of the drive shaft 25, which projects from the rotor 22 on the lower side of the rotor 22, such that the flange 252 projects outward in a horizontal direction, i.e., a radial direction (direction perpendicular to the axial direction). A balance weight 254 is provided in the flange 252. Two balance weights 221, 222 are also provided at upper and lower sides, respectively, of the rotor 22.

The upper end portion of the drive shaft 25 (i.e., the end portion of the drive shaft 25 located on the opposite side of the rotor 22, which is opposite from the compressing device 10 in the top-to-bottom direction), projects from the rotor 22 toward the upper side on the upper side of the rotor 22. The projecting portion of the drive shaft 25, which projects upward from the rotor 22, is rotatably supported by a bearing device 27, 28.

The bearing device 27, 28 includes a bearing member 27 and an intervening member 28. The drive shaft 25 is received through the bearing member 27, and the bearing member 27 is fixed to the casing 30 through the intervening member 28.

The bearing member 27 is fixed to the tubular member 31 of the casing 30 through the intervening member 28. The intervening member 28 is configured into a cup-shaped body having an annular planar bottom wall portion and an outer peripheral wall portion. The outer peripheral wall portion of the intervening member 28 projecting downward in the top-to-bottom direction from an outer peripheral edge of the annular planar bottom wall portion of the intervening member 28, and an outer peripheral surface of the outer peripheral wall portion of the intervening member 28 is fixed to the tubular member 31 of the casing 30.

A flange 271 is formed in an upper end part of the bearing member 27 to project radially outward in the horizontal direction. The flange 271 is placed on the intervening member 28 on the upper side of the intervening member 28. The flange 271 of the bearing member 27 and the intervening member 28 are fixed together by a bolt (not shown). In this way, a horizontal position, i.e., a radial position (i.e., a position in a radial direction perpendicular to the axial direction) of the bearing member 27 relative to the intervening member 28 is adjustable to enable centering of the drive shaft 25.

An axial intermediate portion of the drive shaft 25, which is present between the rotor 22 and the flange 252, is rotatably supported by a bearing portion 291, which is formed in a middle housing 29. The middle housing 29 is configured into a cylindrical tubular body having inner and outer diameters, which are increased in a stepwise manner from the upper side toward the lower side of the middle housing 29 in the top-to-bottom direction. An outer peripheral surface (outermost peripheral surface) of the middle housing 29 is fixed to the cylindrical tubular member 31 of the casing 30 in a contact state where the outer peripheral surface of the middle housing 29 contacts the cylindrical tubular member 31 of the casing 30.

The lower end portion of the drive shaft 25, which is located on the lower side of the rotor 22, is placed in the interior of the middle housing 29, and an upper end portion of the middle housing 29, which has the smallest inner diameter in the middle housing 29, forms the bearing portion 291.

The flange 252 of the drive shaft 25 and the balance weight 254 are received in an axial intermediate portion of the middle housing 29, i.e., an enlarged inner diameter portion of the middle housing 29, which has the inner diameter larger than that of the bearing portion 291.

A movable scroll 11 of the compressing device 10 is received in the lower end side of the middle housing 29, which has the largest inner diameter in the middle hosing 29. A fixed scroll (fixed member) 12 of the compressing device 10 is placed on a lower side of the movable scroll 11.

Each of the movable scroll 11 and the fixed scroll 12 has a base plate portion 111, 121, which is configured into a circular disk plate form. The base plate portion 111 and the base plate portion 121 are opposed to each other in the top-to-bottom direction.

A boss portion 113, which is configured into a cylindrical tubular form, is formed at a center part of the base plate portion 111 of the movable scroll 11, and a lower end part 253 of the drive shaft 25 is inserted into the boss portion 113. The lower end part 253 of the drive shaft 25 is an eccentric portion, which is eccentric to the rotational center of the drive shaft 25. Thereby, the eccentric portion 253 of the drive shaft 25 is received in the movable scroll 11.

A rotation limiting mechanism (not shown) is provided in the movable scroll 11 and the middle housing 29 to limit rotation of the movable scroll 11 about the eccentric portion 253. Therefore, when the drive shaft 25 is rotated, the movable scroll 11 revolves about a revolution center thereof, which is the rotational center (rotational axis) of the drive shaft 25, without rotating about the eccentric portion 253.

Two thrust plates 13, 14 are stacked one after another in the top-to-bottom direction at a location between the movable scroll 11 and the middle housing 29. The upper side (middle housing 29 side) thrust plate 13 is fixed to the middle housing 29. The lower side (movable scroll 11 side) thrust plate 14 is fixed to the movable scroll 11 and is rotated integrally with the movable scroll 11.

The movable scroll 11 has a spiral tooth 112, which is configured into a spiral form and protrudes from the base plate portion 111 toward the fixed scroll 12. The base plate portion 121 of the fixed scroll 12 is fixed to the tubular member 31 of the casing 30, and a spiral tooth 122, which is meshed with the spiral tooth 112 of the movable scroll 11, is formed in an upper surface of the base plate portion 121 (the movable scroll 11 side surface of the base plate portion 121) of the fixed scroll 12. Specifically, a spiral groove is formed in the upper surface of the base plate portion 121 of the fixed scroll 12, and side walls of the spiral groove form the spiral tooth 122.

Each of the spiral tooth 112 of the movable scroll 11 and the spiral tooth 122 of the fixed scroll 12 is configured such that the spiral tooth 112, 122 forms two turns of the spiral. In other words, a winding angle of each of the spiral teeth 112, 122 is 720 degrees.

The spiral tooth 112 of the movable scroll 11 and the spiral tooth 122 of the fixed scroll 12 are meshed with each other to form a plurality of working chambers (compression chambers) 15, each of which is configured into a crescent form. In FIG. 1, only one of the working chambers 15 is indicated with numeral 15 while the rest of the working chambers 15 are not indicated with numeral 15 for the sake of simplicity.

When the movable scroll 11 revolves, each of the working chambers 15 is displaced from the radially outer side toward the center side while a volume of the working chamber 15 is progressively reduced. The refrigerant is supplied to the working chamber 15 through a refrigerant supply passage (not shown). When the volume of each working chamber 15 is reduced, the refrigerant contained in the working chamber 15 is compressed.

Specifically, the refrigerant supply passage includes a refrigerant suction inlet (not shown) and a refrigerant suction passage (not shown). The refrigerant suction inlet is formed in the tubular member 31 of the casing 30, and the refrigerant suction passage is formed in the interior of the base plate portion 121 of the fixed scroll 12. The refrigerant suction passage (not shown) of the base plate portion 121 of the fixed scroll 12 is communicated with a radially outermost part of the spiral groove of the base plate portion 121 of the fixed scroll 12.

A tip seal 16 and a tip seal 17 are installed to the spiral tooth 112 of the movable scroll 11 and the spiral tooth 122 of the fixed scroll 12, respectively, to maintain the fluid-tightness of the working chambers 15. Each of the tip seals 16, 17 is made of a resin material, such as polyether ether ketone (PEEK), and is configured into a rectangular prismatic form, which extends in the spiral direction of the spiral tooth 112, 122.

The tip seal 16 of the movable scroll 11 is fitted into a tip seal groove of the spiral tooth 112, which is formed in a lower surface of the spiral tooth 112 (the surface of the spiral tooth 112 located on the side where the base plate portion 121 of the fixed scroll 12 is located). The tip seal 17 of the fixed, scroll 12 is fitted into a tip seal groove of the spiral tooth 122, which is formed in an upper surface of the spiral tooth 122 (the surface of the spiral tooth 122 located on the side where the base plate portion 111 of the movable scroll 11 is located).

The tip seal 16 is tightly and slidably contacts a bottom surface (slidable surface) of the spiral groove of the base plate portion 121 of the fixed scroll 12, and the tip seal 17 is tightly and slidably contacts a lower surface (slidable surface) of the base plate portion 111 of the movable scroll 11. In this way, the fluid-tightness of the working chambers 15 is implemented to limit leakage of the refrigerant from the working chambers 15.

A discharge hole 123 is formed at a center part of the base plate portion 121 of the fixed scroll 12. The compressed refrigerant, which is compressed in the respective working chambers 15, is discharged through the discharge hole 123. A discharge chamber 124, which is communicated with the discharge hole 123; is formed in the base plate portion 121 of the fixed scroll 12 at the lower side of the discharge hole 123. The discharge chamber 124 is defined by a recess portion 125, which is formed in the lower surface of the fixed scroll 12, and a partition member 18, which is fixed to the lower surface of the fixed scroll 12.

A reed valve (not shown) and a stopper 19 are placed in the discharge chamber 124. The reed valve is a check valve, which limits a backflow of the refrigerant toward the working chambers 15, and the stopper 19 limits a maximum opening degree of the reed valve.

The refrigerant of the discharge chamber 124 is discharged out of the casing 30 through a refrigerant discharge passage (not shown). The refrigerant discharge passage (not shown) includes a refrigerant discharge passage (not shown), which is formed in the base plate portion 121 of the fixed scroll 12, and a refrigerant discharge outlet (not shown), which is formed in the tubular member 31 of the casing 30.

The refrigerant discharge outlet (not shown) of the casing 30 is connected to a refrigerant flow inlet (not shown) of the oil separator 40 through a refrigerant conduit (not shown). The oil separator 40 separates the lubricating oil from the compressed refrigerant, which is discharged from the casing 30, and returns the separated lubricating oil into the casing 30.

The oil separator 40 includes a tubular member 41, an upper cover member 42 and a lower cover member 43. The tubular member 41 is elongated in, i.e., extends in the top-to-bottom direction. The upper cover member 42 closes an upper end part of the tubular member 41, and the lower cover member 43 closes a lower end part of the tubular member 41. The tubular member 41 is made of iron metal and is configured into a cylindrical tubular form, and each of the upper and lower cover members 42, 43 is made of iron metal and is configured into a bowl form. The upper and lower cover members 42, 43 are press-fitted into the tubular member 41 and are fluid-tightly joined to the tubular member 41 by welding.

The tubular member 41 of the oil separator 40 is joined to the tubular member 31 of the casing 30 through a bracket 44 made of iron metal by welding. In this way, the oil separator 40 is fixed to the casing 30.

The upper cover member 42 has an outer tubular member 421 and an inner tubular member 422, which form a double tubular structure. The outer tubular member 421 is a cylindrical tubular member, which is elongated in, i.e., extends in the top-to-bottom direction, and the inner tubular member 422 is also a cylindrical tubular member, which is elongated in, i.e., extends in the top-to-bottom direction. The inner tubular member 422 is inserted in the interior of the outer tubular member 421 at an upper side portion of the outer tubular member 421.

A cylindrical space 143, which extends in the top-to-bottom direction, is formed between the outer tubular member 421 and the inner tubular member 422. The refrigerant, which is supplied through the refrigerant flow inlet (not shown) of the oil separator 40, is guided into the cylindrical space 143. The refrigerant flow inlet (not shown) of the oil separator 40 is formed in the outer tubular member 421 at a location, which is located radially outward of the cylindrical space 143 in the radial direction in the axial extent of the cylindrical space 143.

An upper end part of the cylindrical space 143 is closed by the inner tubular member 422. Specifically, an upper end part of the inner tubular member 422 has an enlarged outer diameter, which is larger than the rest of the inner tubular member 422, and this upper end part of the inner tubular member 422 closes an upper end opening 421*a* of the outer tubular member 421.

An upper end opening 45 of the inner tubular member 422 forms a refrigerant discharge outlet, through which the refrigerant separated from the lubricating oil is discharged to an outside of the oil separator 40 (i.e., an outside of the compressor).

A lower side portion of the oil separator 40 serves as an oil storage tank, which stores the lubricating oil separated from the refrigerant. An oil flow outlet 431 is formed in the lower cover member 43 of the oil separator 40 to discharge the lubricating oil, which is stored in the oil separator 40, to the outside of the oil separator 40.

One end of an oil conduit 46 is connected to the oil flow outlet 431. The other end of the oil conduit 46 is connected to a conduit connecting member 34, which is fixed to the tubular member 31 of the casing 30. The conduit connecting member 34 extends through a through hole, which is formed in the tubular member 31 of the casing 30, and is inserted into an insertion hole 126, which is formed in an outer peripheral surface of the base plate portion 121 of the fixed scroll 12.

A fixed side oil supply passage 127 is formed in the interior of the base plate portion 121 of the fixed scroll 12 to conduct the lubricating oil supplied from the oil separator 40. A movable side oil supply passage (not shown) is formed in the interior of the base plate portion 111 of the movable scroll 11 to intermittently communicate with the fixed side oil supply passage 127.

One end part of the fixed side oil supply passage 127 is communicated with the insertion hole 126. The other end part (not shown) of the fixed side oil supply passage 127 is opened in the upper surface of the base plate portion 121 of the fixed scroll 12 (the surface of the base plate portion 121 located on the side where the base plate portion 111 of the movable scroll 11 is located).

One end part (not shown) of the movable side oil supply passage (not shown) is opened in the lower surface of the base plate portion 111 of the movable scroll 11 (the surface of the base plate portion 111 located on the side where the base plate portion 121 of the fixed scroll 12 is located) in such a manner that the one end part of the movable side oil supply passage (not shown) is opposed to the other end part (not shown) of the fixed side oil supply passage 127.

In this way, the one end part (not shown) of the movable side oil supply passage (not shown) is repeatedly aligned with and is displaced from the other end part (not shown) of the fixed side oil supply passage 127 upon the revolution of the movable scroll 11. Therefore, the movable side oil supply passage (not shown) is intermittently communicated to the fixed side oil supply passage 127.

The other end part of the movable side oil supply passage (not shown) opens in the inner, peripheral surface of the boss portion 113 of the movable scroll 11. Therefore, when movable side oil supply passage (not shown) is communicated with the fixed side oil supply passage 127, the lubricating oil, which is supplied from the oil separator 40, is guided to a gap between the boss portion 113 and the eccentric portion 253 of the drive shaft 25 and is then supplied into the oil supply passage 251 from the lower end part of the drive shaft 25.

A through hole (not shown) is formed through a peripheral wall of the drive shaft 25 to radially outwardly extend from the oil supply passage 251 toward the bearing portion 291 of the middle housing 29. Also, another through hole is formed in the peripheral wall of the drive shaft 25 to radially outwardly extend from the oil supply passage 251 toward the bearing member 27. Therefore, the lubricating oil, which is supplied to the oil supply passage 251, is supplied to each slidable part between the drive shaft 25 and the bearing portion 291 and each slidable part between the drive shaft 25 and the bearing member 27 through these two through holes (not shown), respectively, which are described above.

The lubricating oil, which is supplied between the drive shaft 25 and the bearing portion 291, flows downward through a center hole of the middle housing 29 due to the gravitational force and is supplied between the thrust plate 13 and the thrust plate 14. The lubricating oil, which is supplied between the thrust plate 13 and the thrust plate 14, flows downward through a gap formed between the outer peripheral surface of the base plate portion 111 of the movable scroll 11 and the inner peripheral surface of the middle housing 29 on the radially outer side of the base plate portion 111 of the movable scroll 11 and then flows downward through an oil downflow passage (not shown), which penetrates through the base plate portion 121 of the fixed scroll 12 in the top-to-bottom direction. Then, the lubricating oil is supplied from this oil downflow passage (not shown) to an oil storage chamber 35, which is formed at the lowermost part of the casing 30.

The oil storage chamber 35 is formed on the lower side of the fixed scroll 12 and the partition member 18. A through hole 181 extends through the partition member 18 in the top-to-bottom direction. The through hole 181 is communicated with the refrigerant suction passage (not shown) of the base plate portion 121 of the fixed scroll 12 described above. A pipe 182 is inserted into the through hole 181 from the lower side (the side where the oil storage chamber 35 is located). The pipe 182 is provided to suction the lubricating oil, which is stored in the oil storage chamber 35.

The lubricating oil in the oil storage chamber 35 is supplied to the working chambers 15 through the through hole 181 of the partition member 18 and the refrigerant suction passage (not shown) of the base plate portion 121 of the fixed scroll 12.

Next, the operation of the compressor of the present embodiment will be described. When the rotor 22 and the drive shaft 25 are rotated upon the supplying of the electric power to the stator coils 212 of the electric motor device 20, the movable scroll 11 revolves about the rotational center of the drive shaft 25. In this way, the crescent shaped working chambers 15, which are formed between the spiral tooth 112 of the movable scroll 11 and the spiral tooth 122 of the fixed scroll 12, are radially displaced from the radially outer side toward the center in such a manner that the volume of each of the crescent shaped working chambers 15 is progressively decreased as it approaches the center.

At this time, the refrigerant and the lubricating oil of the oil storage chamber 35 are supplied to the working chamber 15 located at the radially outer side. Specifically, the external refrigerant, which is received from the outside of the compressor, is supplied to the working chamber 15 through the refrigerant suction inlet (not shown) of the casing 30 and the refrigerant suction passage (not shown) of the base plate portion 121 of the fixed scroll 12. At the same time, the lubricating oil stored in the oil storage chamber 35 is supplied to the working chamber 15 through the pipe 182, the through hole 181 of the partition member 18 and the refrigerant suction passage (not shown) of the base plate portion 121 of the fixed scroll 12.

The refrigerant, which is supplied to the working chamber 15, is compressed upon the decreasing of the volume of the working chamber 15. The refrigerant, which is compressed in the working chamber 15, is discharged to the outside of the casing 30 through the discharge hole 123 of the fixed scroll 12, the discharge chamber 124 of the fixed scroll 12 and the refrigerant discharge outlet (not shown) of the casing 30. Thereafter, the refrigerant, which is discharged from the casing 30, is supplied to the refrigerant flow inlet (not shown) of the oil separator 40 through the refrigerant conduit (not shown).

The refrigerant, which is supplied to the refrigerant flow inlet of the oil separator 40, is guided into the cylindrical space 143 of the oil separator 40. Then, the refrigerant forms a swirl flow in the cylindrical space 143, and the swirl flow of the refrigerant creates a centrifugal force. Due to the action of the centrifugal force, the lubricating oil is separated from the refrigerant.

The refrigerant, from which the lubricating oil is separated, is discharged from the refrigerant discharge outlet 45 of the oil separator 40 as the discharged refrigerant, which is discharged from the compressor. In contrast, the lubricating oil, which is separated from the refrigerant, flows downward in the interior of the oil separator 40 due to the influence of the gravitational force, and this refrigerant is stored in the lower part of the interior of the oil separator 40. The lubricating oil, which is stored in the oil separator 40, is intermittently supplied to the oil supply passage 251 of the drive shaft 25.

Specifically, as described above, upon the revolution of the movable scroll 11, the movable side oil supply passage (not shown) is intermittently communicated with the fixed side oil supply passage 127 of the fixed scroll 12. Thereby, the lubricating oil, which is stored in the oil separator 40, is supplied to the gap between the boss portion 113 of the movable scroll 11 and the eccentric portion 253 of the drive shaft 25 through the oil conduit 46, the conduit connecting member 34, the fixed side oil supply passage 127 and the movable side oil supply passage (not shown) and is then supplied to the oil supply passage 251 of the drive shaft 25 from the lower end part of the drive shaft 25.

In the state where the movable side oil supply passage (not shown) is not communicated with the fixed side oil supply passage 127, the supply of the lubricating oil to the oil supply passage 251 of the drive shaft 25 is blocked.

The lubricating oil, which is supplied to the oil supply passage 251 of the drive shaft 25, is supplied between the drive shaft 25 and the bearing portion 291 and also between the drive shaft 25 and the bearing member 27 through the through holes (not shown) of the drive shaft 25 described above. In this way, the lubrication of the slidable parts of the drive shaft 25 can be appropriately maintained.

The lubricating oil, which is supplied between the drive shaft 25 and the bearing portion 291, flows downward through a center hole of the middle housing 29 due to the gravitational force and is supplied between the thrust plate 13 and the thrust plate 14. In this way, the lubrication of the lubricating parts between the thrust plate 13 and the thrust plate 14 can be appropriately maintained.

The lubricating oil, which is supplied between the thrust plate 13 and the thrust plate 14, flows downward through the gap formed between the outer peripheral surface of the base plate portion 111 of the movable scroll 11 and the inner peripheral surface of the middle housing 29 on the radially outer side of the base plate portion 111 of the movable scroll 11 and then flows downward through the oil downflow passage (not shown), which penetrates through the base plate portion 121 of the fixed scroll 12 in the top-to-bottom direction. Then, the lubricating oil reaches the oil storage chamber 35 in the lowermost part of the hosing 30.

Next, a manufacturing method of the compressor of the present embodiment will be described with reference to FIGS. 3 to 5B. With reference to a flowchart of FIG. 3, at step S1, the internal components to be received into the casing 30, specifically, the compressing device 10, the electric motor device 20, the drive shaft 25 and the bearing device 27, 28 are assembled into the tubular member 31 (assembling step).

These internal components to be received into the casing 30 can be fixed to the tubular member 31 by welding. Specifically, a lower hole is preformed in the tubular member 31 at a location where the internal components are placed. After the assembling of the internal components into the tubular member 31, the welding is performed on the outer surface of the tubular member 31 to close the lower hole of the tubular member 31. In this way, the internal components are fixed to the tubular member 31 by the welding.

Here, it is desirable that the external components (e.g., the bracket 44), which are fixed to the outer surface of the tubular member 31, are prefixed to the outer surface of the tubular member 31 by welding before the assembling step.

Next, at step S2, the lower cover member 33 is fixed to the tubular member 31 by welding. Specifically, at step S2, the lower cover member 33 is press-fitted into the tubular member 31 and is then welded to the tubular member 31 along an entire circumference of the tubular member 31 (all-around welding step).

Thereafter, at step S3, centering of the drive shaft 25 is executed (centering step). Specifically, a horizontal position (i.e., a position in a radial direction that is perpendicular to the axial direction) of the bearing member 27, which is fixed to the intervening member 28 through the bolt, is adjusted to perform the centering of the drive shaft 25.

Then, at step S4, the upper cover member 32 is fixed to the tubular member 31 by the all-around welding (all-around welding step). Specifically, the upper cover member 32 is press-fitted into the tubular member 31 and is welded to the tubular member 31 along the entire circumference of the tubular member 31.

Figure 4:
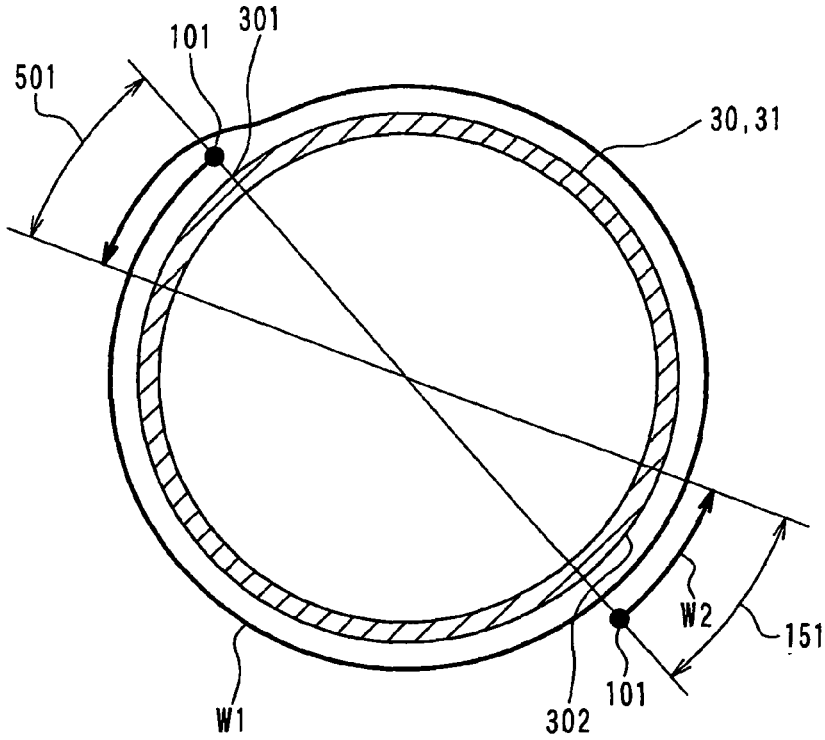
FIG. 4 is a schematic cross-sectional view of a casing of the compressor, schematically showing an all-around welding step in the manufacturing method indicated in FIG. 3.

FIG. 4 is a schematic diagram schematically showing the all-around welding step. In the all-around welding step, a welding torch 101 is moved all around the casing 30 in the circumferential direction from a welding start point 301, at which the all-around welding W1 is started, to perform the all-around welding W1 along the entire circumference of the casing 30 (tubular member 31). At the end of the all-around welding W1, an overlapped portion (overlapped welding portion) 501 is formed in the welding bead 50 by overlapping the welding W1. That is, the welding torch 101 is moved through the angular range larger than 360 degrees beyond the welding start point 301 to form the overlapped portion 501.

By forming the overlapped portion 501, it is possible to implement the required sealing performance at the welding start point 301 where the weld penetration is unstable. A circumferential formation range (circumferential extent) of the overlapped portion 501 is desirably about 15 degrees in the circumferential direction of the casing 30. Therefore, the welding torch 101 should be moved through about an angular range of about 375 degrees (i.e., 360 degrees+about 15 degrees), along an imaginary circle, which is located radially outward of the casing 30 and is coaxial with the casing 30. An overlapped portion, which is similar to the overlapped portion 501, is also formed at the all-around welding between the tubular member 31 and the lower cover member 33 described above.

In addition to the all-around welding W1, an additional welding bead 151 is formed by performing additional welding W2 at a diametrically opposite portion 302 of the casing 30, which is diametrically opposite from the overlapped portion 501, i.e., which is circumferentially displaced generally by 180 degrees. A size of a circumferential formation range (circumferential extent) of the additional welding bead 151 is desirably the same as that of the overlapped portion 501.

Figure 5A:
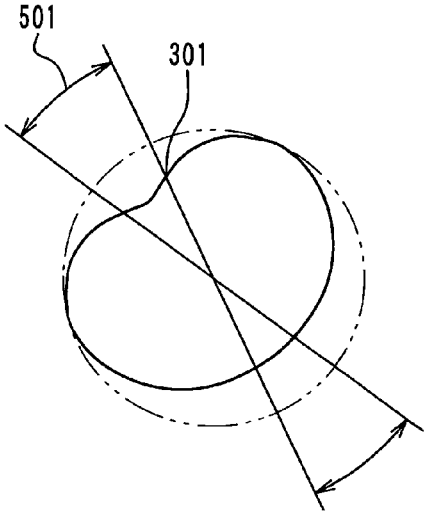
FIG. 5A is a schematic cross-sectional view of the casing of the compressor in a state before execution of additional welding in the manufacturing method of the first embodiment.
Figure 5B:
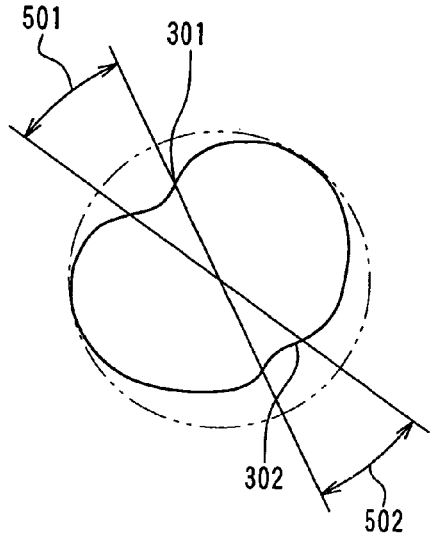
FIG. 5B is a schematic cross-sectional view of the casing of the compressor in a state after the execution of the additional welding in the manufacturing method of the first embodiment.

FIGS. 5A and 5B show a change in a diameter of the portion of the casing 30, which is welded by the all-around welding. Specifically, FIG. 5A shows the state before the execution of the additional welding W2, i.e., the state immediately after the execution of the all-around welding W1. FIG. 5B shows the state after the execution of the additional welding W2.

In the all-around welding W1, the amount of heat input at the circumferential portion of the casing 30, which includes the welding start point 301 and the vicinity thereof, becomes larger than that of the other circumferential portion of the casing (tubular member 31) due to the overlapping of the welding at the welding start point 301. Therefore, as shown in FIG. 5A, a welding distortion at the circumferential portion, which includes the welding start point 301 and the vicinity thereof, becomes larger than that of the other circumferential portion.

Specifically, the inner diameter of the casing 30 at the circumferential portion, which includes the welding start point 301 and the vicinity thereof, becomes smaller than the inner diameter of the casing 30 at the other circumferential portion, and thereby the casing 30 is thermally, non-symmetrically deformed in the radial direction. In this state, the location of the bearing member 27, which is adjusted in the centering step, is deviated from its appropriate location (designated location), and thereby the location of the center axis of the drive shaft 25 is also deviated from its appropriate location, i.e., is decentered.

In the present embodiment, the additional welding W2 is performed at the diametrically opposite portion 302 of the casing 30 in this state. Therefore, as shown in FIG. 5B, a welding distortion is generated at the diametrically opposite portion 302 of the casing 30. Specifically, the inner diameter of the casing 30 at the diametrically opposite portion 302 becomes smaller, and thereby the casing 30 is thermally, symmetrically deformed about the center axis of the casing 30, i.e., the thermal deformations at the overlapped portion 501 and the diametrically opposite portion 302, respectively, of the casing 30 are symmetrically made.

Thereby, in comparison to the state of FIG. 5A (the state before the execution of the additional welding W2), the location of the bearing member 27 approaches to its appropriate location, which is the location adjusted at the centering step. Thereby, the amount of deviation of the center axis of the drive shaft 25 from its appropriate location (the amount of decentering of the drive shaft 25) is reduced.

That is, in the compressor of the present embodiment, a thermally deformed portion is formed in the diametrically opposite portion 302 of the casing 30, which is diametrically opposite from the overlapped portion 501, by the externally applied heat input (specifically, the additional welding W2). Thus, the diametrically opposite portion 302 of the casing 30 may be also referred to as the thermally deformed portion in the manufactured compressor. This thermally deformed portion, i.e., the diametrically opposite portion 302 is deformed symmetrically with respect to the welding distortion at the overlapped portion 501. Therefore, in comparison to the case where the casing 30 is thermally deformed only at the overlapped portion 501 while the thermally deformed portion is not formed in the diametrically opposite portion 302 (thereby the casing 30 being non-symmetrically thermally deformed only at the overlapped portion 501), the positioning accuracy of the bearing device 27, 28 can be improved. As a result, the amount of decentering of the drive shaft 25 can be reduced, and thereby the operational reliability of the compressor can be improved.

In a case where tack welding (temporary welding) is executed before the execution of the all-around welding W1, in order to limit the non-symmetrical thermal deformation of the casing 30 by the tack welding, it is preferable that the tack welding is executed at a plurality of locations of the casing 30 such that each of these locations is symmetrical with another one of these locations, i.e., is placed diametrically opposite from that of another one of these locations.

Second Embodiment

In the first embodiment, the additional welding W2 is executed in addition to the all-around welding W1, so that the thermal deformations of the casing 30 are symmetrically made. In a second embodiment of the present invention, at the time of executing the all-around welding W1, a welding condition at the diametrically opposite portion 302 of the casing 30 (tubular member 31) is changed from that of the remaining circumferential portion of casing 30 to make the symmetrical thermal deformations of the casing 30.

Figure 6:
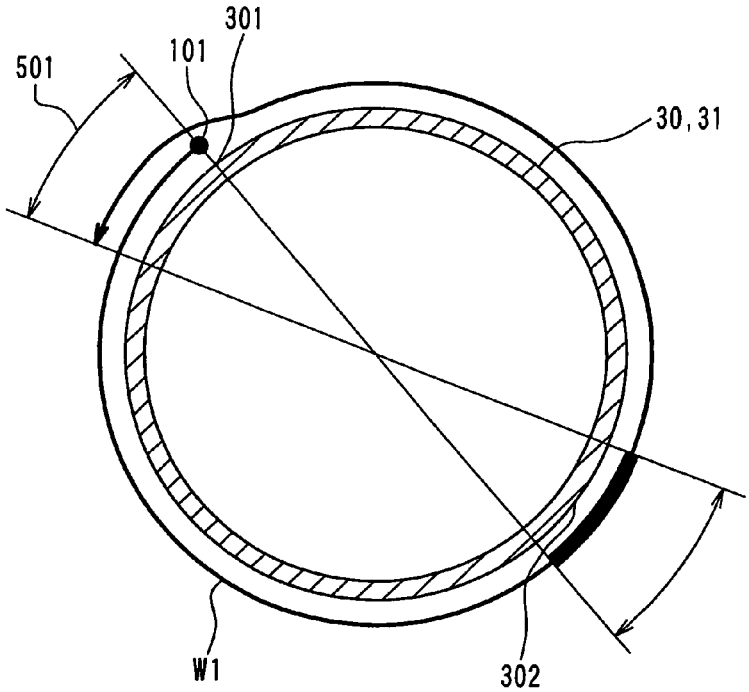
FIG. 6 is a schematic cross-sectional view of a casing of a compressor according to a second embodiment of the present invention, schematically showing an all-around welding step in a manufacturing method of the second embodiment.

FIG. 6 is a schematic diagram schematically showing the all-around welding step of the present embodiment. In the present embodiment, at the time of performing the all-around welding W1 at the all-around welding step, the moving speed of the welding torch 101 at the diametrically opposite portion 302 of the casing 30 is made lower than the moving speed of the welding torch 101 at the remaining circumferential portion of the casing 30 that is other than the diametrically opposite portion 302.

In this way, the amount of heat input at the diametrically opposite portion 302 of the casing 30 becomes as large as that of the circumferential portion of the casing 30, which includes the welding start point 301 and the vicinity thereof, without a need for executing the additional welding W2. Therefore, similar to the first embodiment, the inner diameter of the casing 30 at the diametrically opposite portion 302 becomes smaller, and thereby the thermal deformations of the casing 30 are symmetrically made.

As a modification of the present embodiment, a current value of the welding current, which is supplied to energize the welding torch 101, may be changed as follows instead of or in addition to the changing of the moving speed of the welding torch 101. Specifically, the current value of the welding current supplied to energize the welding torch 101 at the time of, welding the diametrically opposite portion 302 of the casing 30 is set to be larger than the current value of the welding current supplied to energize the welding torch 101 at the time of welding the remaining circumferential portion of the casing 30 that is other than the diametrically opposite portion 302.

Third Embodiment

Figure 7:
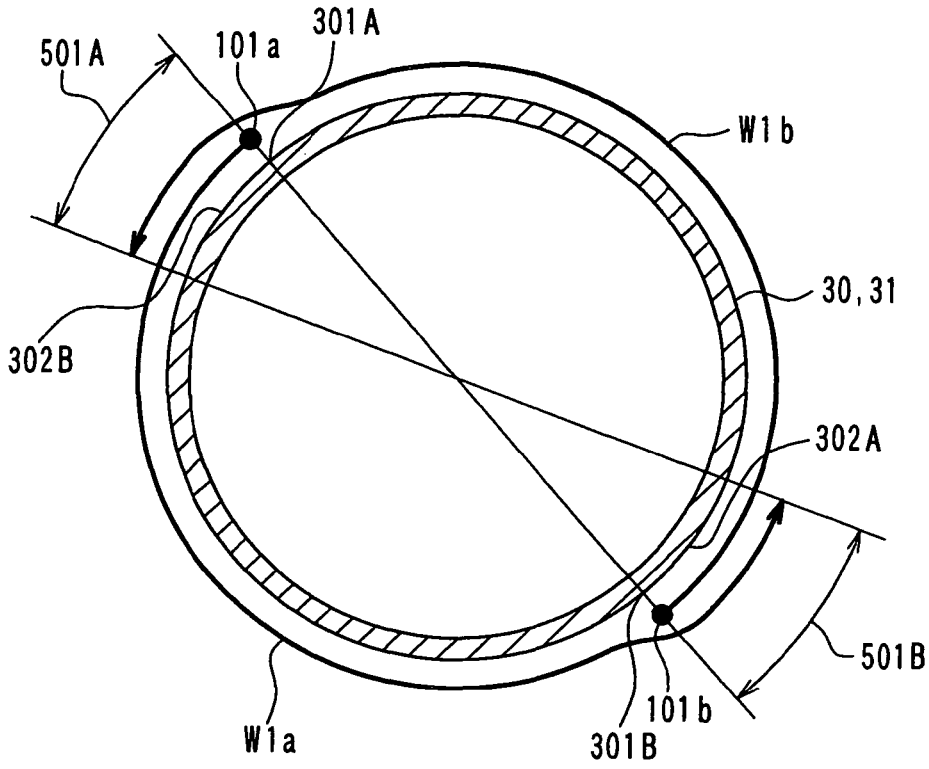
FIG. 7 is a schematic cross-sectional view of a casing of a compressor according to a third embodiment of the present invention, schematically showing an all-around welding step in a manufacturing method of the third embodiment.

In the first embodiment, the additional welding W2 is executed in addition to the all-around welding W1, so that the thermal deformations of the casing 30 (tubular member 31) are symmetrically made. In a third embodiment of the present invention, as shown in FIG. 7, at the time of performing the all-around welding W1, two welding torches (first and second welding torches) 101*a*, 101*b* are used to make the symmetrical thermal deformations of the casing 30.

Specifically, the two welding torches 101*a*, 101*b* are positioned at two diametrically opposed locations (first and second locations), respectively, which are located radially outward of the casing (tubular member 31) and are diametrically opposite to each other about the casing (tubular member 31), i.e., are displaced from each other generally by 180 degrees. One (i.e., the welding torch 101*a*) of these two welding torches 101*a*, 101*b* is used to execute half-around welding W1*a* of the casing 30, and the other one (i.e., the welding torch 101*b*) of these two welding torches 101*a*, 101*b* is simultaneously used to execute another half-around welding W1*b* in the same circumferential direction as that of the half-around welding W1*a*. In this way, the all-around welding W1 is made.

At the end of each of the half-around welding W1*a* and the half-around welding W1*b*, the welding torch 101*a*, 101*b* of the half-around welding W1*a*, W1*b* is circumferentially moved beyond the welding start point 301A, 301B of the other one of the half-around welding W1*a* and the half-around welding W1*b*. In this way, two overlapped portions 501A, 501B are symmetrically made in the casing 30 about the center axis of the casing 30.

That is, the second overlapped portion 501B is formed at the diametrically opposite portion 302A of the casing 30, which is diametrically opposite from the first overlapped portion 501A of the casing 30. In other words, the first overlapped portion 501A is formed at the diametrically opposite portion 302B of the casing 30, which is diametrically opposite from the second overlapped portion 501B.

According to the present embodiment, the two overlapped portions, i.e., the first and second overlapped portions 501A, 501B are symmetrically made, so that the heat inputs to the casing 30 are symmetrically made. Therefore, similar to the first embodiment, the thermal deformations of the casing 30 can be symmetrically made according to the present embodiment.

The present invention is not limited to the above embodiments, and the above embodiments may be modified as follows.

(1) In each of the above embodiments, the example of the specific structure of the compressor is, merely illustrated. The present invention is not limited to the above-described structure of the compressor, and the above-described structure of the compressor may be modified in various ways without departing the spirit and scope of the present invention.

For instance, in each of the above embodiments, the oil separator 40 is placed at the outside of the casing 30. Alternatively, the oil separator 40 may be received in the casing 30.

Furthermore, in each of the above embodiments, the present invention is implemented in the upright compressor (upright type compressor), in which the compressing device 10 and the electric motor device 20 are placed one after another in the top-to-bottom direction (vertical direction). Alternatively, the present invention is also applicable to a horizontal compressor (horizontal type compressor), in which the compressing device 10 and the electric motor device 20 are placed one after another in the horizontal direction (transverse direction).

(2) In each of the above embodiments, the heat pump cycle forms the supercritical refrigeration cycle, and the carbon dioxide is used as the refrigerant. Alternatively, the heat pump cycle may form a subcritical refrigeration cycle, in which the high pressure side refrigerant pressure does not become equal to or higher than the critical pressure of the refrigerant, and the refrigerant may be chlorofluorocarbon refrigerant or hydrocarbon refrigerant.

(3) In each of the above embodiments, the compressor of the present invention is applied to the heat pump cycle. However, the compressor of the present invention can be applied to various types of refrigeration cycles.

(4) In each of the above embodiments, the present invention is applied to the scroll compressor. However, the present invention may be widely applied to other types of compressors, such as a compressor, which compresses fluid by displacing a movable member relative to the fixed member (e.g., a reciprocal compressor, a rotary compressor).

(5) In each of the above embodiments, the welding torch(es) 101, 101*a*, 101*b* is positioned in place and is moved around the casing 30 (i.e., the upper or lower cover member 32, 33 and the tubular member 31) in the circumferential direction at the time of welding the upper or lower cover member 32, 33 to the tubular member 31. Alternatively, at the time of welding, the casing 30, (i.e., the upper or lower cover member 32, 33 and the tubular member 31) may be rotated relative to the welding torch(es) 101, 101*a*, 101*b*, which is held stationary at its designated location.

Additional advantages and modifications will readily occur to those skilled in the art. The invention in its broader terms is therefore not limited to the specific details, representative apparatus, and illustrative examples shown and described.

What is claimed is:

1. A compressor comprising:

a compressing device that is configured to compress fluid;

a casing that receives the compressing device;

a drive shaft that drives the compressing device; and a bearing device that rotatably supports the drive shaft relative to the casing, wherein:

the casing includes a tubular member, which extends coaxially with respect to the drive shaft, and a cover member, which covers an end opening of the tubular member;

the cover member is fixed to the tubular member by all-around welding;

a welding bead is formed by the all-around welding in an outer peripheral surface of the casing along an entire circumference of the casing;

the welding bead includes an overlapped portion, which is formed by overlapping of welding over a welding start point, at which the all-around welding is started;

a thermally deformed portion, which is deformed by externally applied heat input, is formed in a diametrically opposite portion of the casing, which is diametrically opposite to the overlapped portion; and the thermally deformed portion is deformed symmetrically with respect to a welding distortion at the overlapped portion.

2. The compressor according to claim 1, wherein:

an additional welding bead is formed in the diametrically opposite portion by additional welding, which is executed in addition to the all-around welding; and the thermally deformed portion is a portion, in which the welding distortion is generated by the additional welding.

3. A compressor comprising:

a compressing device that is configured to compress fluid;

a casing that receives the compressing device;

a drive shaft that drives the compressing device; and a bearing device that rotatably supports the drive shaft relative to the casing, wherein:

the casing includes a tubular member, which extends coaxially with respect to the drive shaft, and a cover member, which covers an end opening of the tubular member;

the cover member is fixed to the tubular member by all-around welding;

a welding bead is formed by the all-around welding in an outer peripheral surface of the casing along an entire circumference of the casing;

the welding bead includes an overlapped portion, which is formed by overlapping of welding over a welding start point, at which the all-around welding is started; and an additional bead is formed in a diametrically opposite portion of the casing, which is diametrically opposite to the overlapped portion, by additional welding that is executed in addition to the all-around welding.

4. A manufacturing method of a compressor that includes a compressing device, which is configured to compress fluid, a casing, which receives the compressing device, a drive shaft, which drives the compressing device, and a bearing device, which rotatably supports the drive shaft relative to the casing, wherein the casing includes a tubular member, which extends coaxially with respect to the drive shaft, and a cover member, which covers an end opening of the tubular member, the manufacturing method comprising:

assembling the compressing device, the drive shaft and the bearing device into the tubular member; and performing all-around welding of the cover member to the tubular member, into which the compressing device, the drive shaft and the bearing device are assembled, to form the casing in such a manner that welding is overlapped over a welding start point, at which the all-around welding is started, to form an overlapped portion in a welding bead generated by the all-around welding, wherein the performing of the all-around welding includes externally applying heat input to a diametrically opposite portion of the casing, which is diametrically opposite to the overlapped portion, so that the diametrically opposite portion is deformed symmetrically with respect to a welding distortion at the overlapped portion.

5. The manufacturing method according to claim 4, wherein the performing of the all-around welding includes performing additional welding at the diametrically opposite portion in addition to the all-around welding to apply the heat input to the diametrically opposite portion of the casing.

6. The manufacturing method according to claim 4, wherein the performing of the all-around welding includes changing a welding condition of the all-around welding at the diametrically opposite portion from a welding condition of a remaining circumferential portion of the casing to apply the heat input to the diametrically opposite portion of the casing.

7. The manufacturing method according to claim 4, wherein the performing of the all-around welding includes:

positioning first and second welding torches at first and second locations, respectively, which are located radially outward of the casing and are diametrically opposite to each other about the casing; and actuating the first and second welding torches to simultaneously perform welding from each of the first and second locations along the casing in a common circumferential direction by using the first and second welding torches and thereby to form the all-around welding, wherein each of the first and second welding torches forms the overlapped portion associated therewith by overlapping the welding over the welding start point of the other one of the first and second welding torches and applies the heat input to the diametrically opposite portion associated therewith.

* * * * *